US009353540B2

(12) United States Patent
Jennings

(10) Patent No.: US 9,353,540 B2
(45) Date of Patent: May 31, 2016

(54) SWIMMING POOL PILLOW

(71) Applicant: Joseph Jennings, Sarasota, FL (US)

(72) Inventor: Joseph Jennings, Sarasota, FL (US)

( * ) Notice: Subject to any disclaimer, the term of this patent is extended or adjusted under 35 U.S.C. 154(b) by 452 days.

(21) Appl. No.: 13/929,931

(22) Filed: Jun. 28, 2013

(65) Prior Publication Data

US 2014/0020171 A1 Jan. 23, 2014

Related U.S. Application Data

(60) Provisional application No. 61/672,396, filed on Jul. 17, 2012.

(51) Int. Cl.
*E04H 4/10* (2006.01)

(52) U.S. Cl.
CPC ..... *E04H 4/103* (2013.01)

(58) Field of Classification Search
CPC ..... E04H 4/103
USPC ..... 4/499
See application file for complete search history.

(56) References Cited

U.S. PATENT DOCUMENTS

| | | | | |
|---|---|---|---|---|
| D213,867 | S | 4/1969 | Perlman | |
| 3,533,110 | A * | 10/1970 | Gisondi | E04H 4/103 4/499 |
| 3,816,859 | A | 6/1974 | Mosehauer | |
| 3,927,427 | A | 12/1975 | Aine | |
| 4,109,325 | A | 8/1978 | Shuff | |
| 4,122,561 | A | 10/1978 | Barr | |
| 4,606,083 | A | 8/1986 | Kingston | |
| 4,825,479 | A | 5/1989 | Bonneau | |
| 4,953,239 | A | 9/1990 | Gadsby | |
| D321,254 | S | 10/1991 | Harp | |
| D446,585 | S | 8/2001 | Webb | |
| D470,210 | S | 2/2003 | Rodriguez et al. | |
| 7,874,023 | B1 | 1/2011 | Sundling | |
| 8,347,876 | B2 * | 1/2013 | Rosene | F24J 2/0472 4/499 |
| 2007/0000182 | A1 * | 1/2007 | Boujon | E04H 4/103 52/2.17 |
| 2010/0058529 | A1 * | 3/2010 | Decker | E04H 4/103 4/499 |

* cited by examiner

*Primary Examiner* — Tuan N Nguyen
(74) *Attorney, Agent, or Firm* — Buckingham, Doolittle & Burroughs, LLC

(57) ABSTRACT

A cover device for a swimming pool is disclosed that effectively keeps out debris including leaves, branches, or even small animals, and helps trap heat underneath the cover saving users the cost of a pool heater. The cover device comprises a flexible member that can be folded up for storage when deflated. Once the flexible member is substantially inflated, the exterior surface forms a generally convex shape which allows the flexible member to float on and cover substantially an entire surface of the swimming pool. The cover device further comprises a plurality of handles secured around a perimeter of the flexible member, and a skirt secured below the plurality of handles. The skirt is inflated and weighted, such that the skirt retains the flexible member on the surface of the swimming pool, sealing the swimming pool.

13 Claims, 5 Drawing Sheets

SWIMMING POOL PILLOW

CROSS-REFERENCE

This application claims priority from Provisional Patent Application Ser. No. 61/672,396 filed Jul. 17, 2012.

BACKGROUND

Traditional pool covers may not be effective for keeping an outdoor in-ground or above-ground pool clean. These covers are only thin layers that are stretched over the top of the pool, which may leave gaps in the sides. Strong winds can blow debris under these traditional pool covers, and small animals can accidentally find themselves trapped underneath, where they may drown in the pool. Thus, the swimming pool can become a dangerous hotspot for the growth of bacteria and germs. Furthermore, traditional pool covers are also not effective at retaining heat in the pool, thereby causing individuals to have to spend extra money installing and operating a pool heater. An effective solution is necessary.

The present invention provides a modified pool cover for outdoor swimming pools designed to effectively keep out debris including leaves, branches, or even small animals. The cover device can be inflated to fill the surface area of the pool. Further, a weighted skirt along the edges of the cover device can ensure the sides stay securely in place across the pool. Users will be able to better enjoy their swimming pool because the cover device ensures clean water when they use the pool. Pool owners can also appreciate the increase in hygiene this device provides, as it blocks animals and insects from entering the pool and accidentally drowning. Furthermore, heat is also trapped underneath the cover device, helping this device to act as a natural pool heater and saving users the cost of a pool heater. Anyone with an outdoor or indoor pool would benefit from this innovative device.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a cover device for a swimming pool that effectively keeps out debris including leaves, branches, or even small animals, and helps trap heat underneath the cover saving users the cost of a pool heater. The cover device comprises a flexible member comprising an exterior surface and an interior cavity. The flexible member can be inflated or deflated, and once deflated the flexible member can be folded up for storage. The flexible member can be inflated via a pump valve located on the exterior surface of the flexible member that is in communication with the interior cavity. A user would attach an air pump to the pump valve to inflate the interior cavity of the flexible member. Wherein, once the flexible member is substantially inflated, the top, exterior surface forms a generally convex shape which allows the flexible member to float on and cover substantially an entire surface of the swimming pool. The generally convex shape prevents debris, including leaves, branches, or even small animals from remaining on the exterior surface of the flexible member.

In a preferred embodiment, the cover device further comprises a plurality of handles which are secured around a perimeter of the flexible member, that enable a user to pull the cover device onto or off of the swimming pool with ease. The cover device further comprises a skirt that is secured around a perimeter of the flexible member, below the plurality of handles. The skirt is detachable and can be secured to the flexible member via straps which are tied to the plurality of handles. The skirt would typically be inflated by a user and weighted, such that the skirt retains the flexible member on the surface of the swimming pool, sealing the swimming pool and preventing any debris, including leaves, branches, or even small animals from entering the pool water. The weighted skirt and flexible member also act as a natural insulator for the pool, trapping heat underneath the cover device which retains existing heat in the pool water.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DESCRIPTION OF PREFERRED EMBODIMENTS

Figure 1:
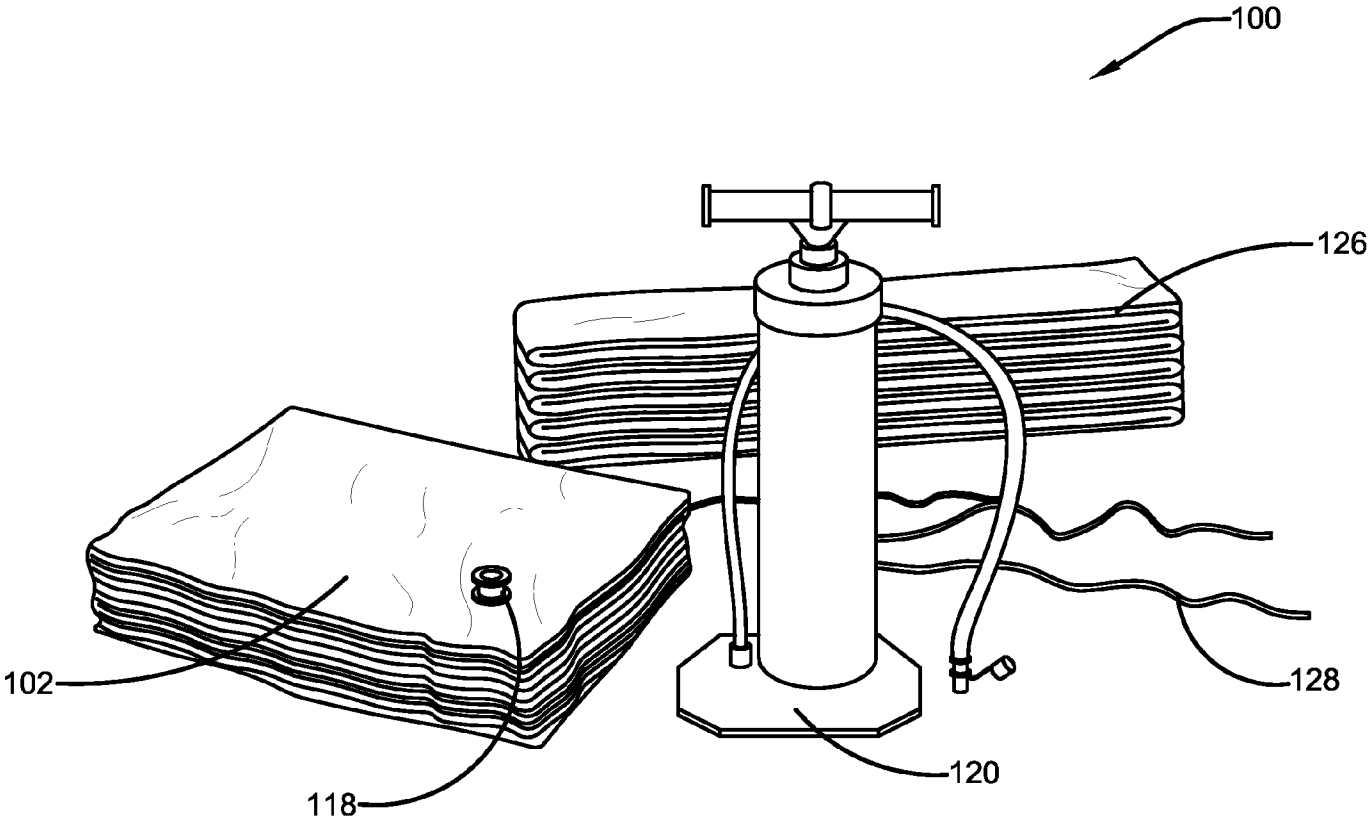
FIG. 1 illustrates a perspective view of the deflated cover device and included pump in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention discloses a modified pool cover device for outdoor swimming pools designed to effectively keep out debris including leaves, branches, or even small animals. The cover device can be inflated to fill the surface area of the pool. Further, a weighted skirt along the edges of the cover device can ensure the sides stay securely in place across the pool. Users will be able to better enjoy their swimming pool because the cover device ensures clean water when they use the pool. Pool owners can also appreciate the increase in hygiene this device provides, as it blocks animals and insects from entering the pool and accidentally drowning.

Furthermore, heat is also trapped underneath the cover device, helping this device act as a natural insulator and saving users the expense of purchasing and operating a pool heater. The cover device can also reduce the amount of water loss due to evaporation. Anyone with a pool would benefit from this innovative device.

The cover device for a swimming pool comprises a flexible member that has an interior cavity that can be inflated or deflated, and once deflated the flexible member can be folded up for convenient storage. Once the flexible member is substantially inflated, the top, exterior surface forms a generally convex shape which allows the flexible member to float on and cover substantially an entire surface of the swimming pool. The cover device further comprises a plurality of handles secured around a perimeter of the flexible member, and a skirt also secured around the perimeter and preferably below the plurality of handles. The skirt is inflated and weighted, such that the skirt retains the flexible member on the surface of the swimming pool, sealing the swimming pool.

Referring initially to the drawings, FIGS. 1-4 illustrate the cover device 100 for a swimming pool that effectively keeps out debris including leaves, branches, or even small animals, and helps trap heat underneath the cover saving users the cost of owning and operating a pool heater. The cover device 100 comprises a flexible member 102 further comprised of an exterior surface 104 and an interior cavity (not shown). Use of the cover device 100 will be climate and surroundings dependent, that is the cover device 100 may only be necessary during inclement weather conditions.

Typically, the flexible member 102 is round or rectangular-shaped, however any other suitable shape can be used as is known in the art without affecting the overall concept of the invention, provided that the flexible member 102 substantially covers the entire surface area of the swimming pool or swimming pool water. Specifically, the flexible member 102 can be shaped and sized to fit virtually any above-ground or in-ground swimming pool, hot tub, or the like, and comprises a periphery having a general shape of the above-ground or in-ground swimming pool, hot tub, etc. The flexible member 102 would generally be constructed of rip-stop nylon, canvas, polyvinyl chloride (PVC), Kevlar®, or any other similar lightweight, weatherproof, flexible material, etc., though any other suitable material may be used to manufacture the flexible member 102 as is known in the art without affecting the overall concept of the invention. The flexible member 102 can also comprise a variety of sizes, shapes, colors and designs to suit user and manufacturing preference. Generally, the flexible member 102, when fully extended and inflated, is approximately between 20 and 30 feet long as measured from a first end 108 to a second end 110, and approximately between 15 and 20 feet wide as measured from opposing sides 112, and approximately between 2 and 3 feet high as measured from a front surface 114 to a back surface 116, at its highest point. Generally, the measurements of the flexible member 102 would depend on the size of the pool and can be custom built.

Figure 2:
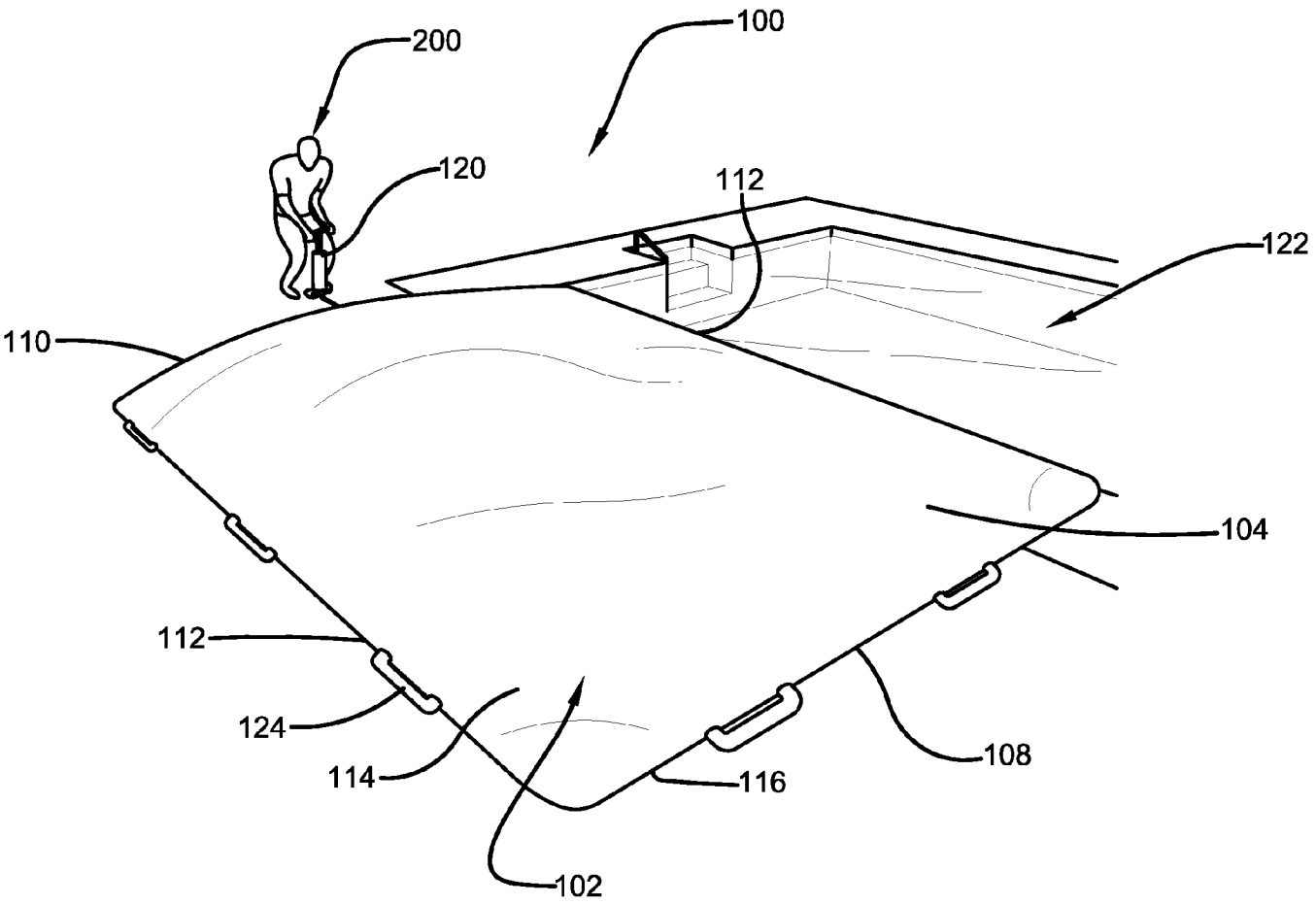
FIG. 2 illustrates a perspective view of the cover device being inflated in accordance with the disclosed architecture.

The interior cavity of the flexible member 102 can be deflated, and once deflated the flexible member 102 can be folded up for storage (as shown in FIG. 1). The interior cavity of the flexible member 102 can also be inflated via a pump valve 118 located on any suitable position on the exterior surface 104 of the flexible member 102, such as on the front surface 114. A user 200 would attach a manual or powered air pump 120 to the pump valve 118, and then would proceed to pump air into the interior cavity of the flexible member 102 (as shown in FIG. 2). Wherein, once the flexible member 102 is substantially inflated, (i.e., the interior cavity is substantially filled with air), the exterior surface 104 forms a generally convex shape which allows the flexible member 102 to float on and cover substantially an entire surface of the swimming pool 122. The generally convex shape prevents debris, including leaves, branches, or even small animals from remaining on the flexible member 102. The generally convex shape forces the debris to slide down from the center of the flexible member 102 and slide off the edges onto the ground. Thus, the debris does not remain on the flexible member 102, weighing it down and degrading the flexible member 102. Furthermore, since the cover device 100 is mostly air, it will be easy to handle and move.

Figure 3:
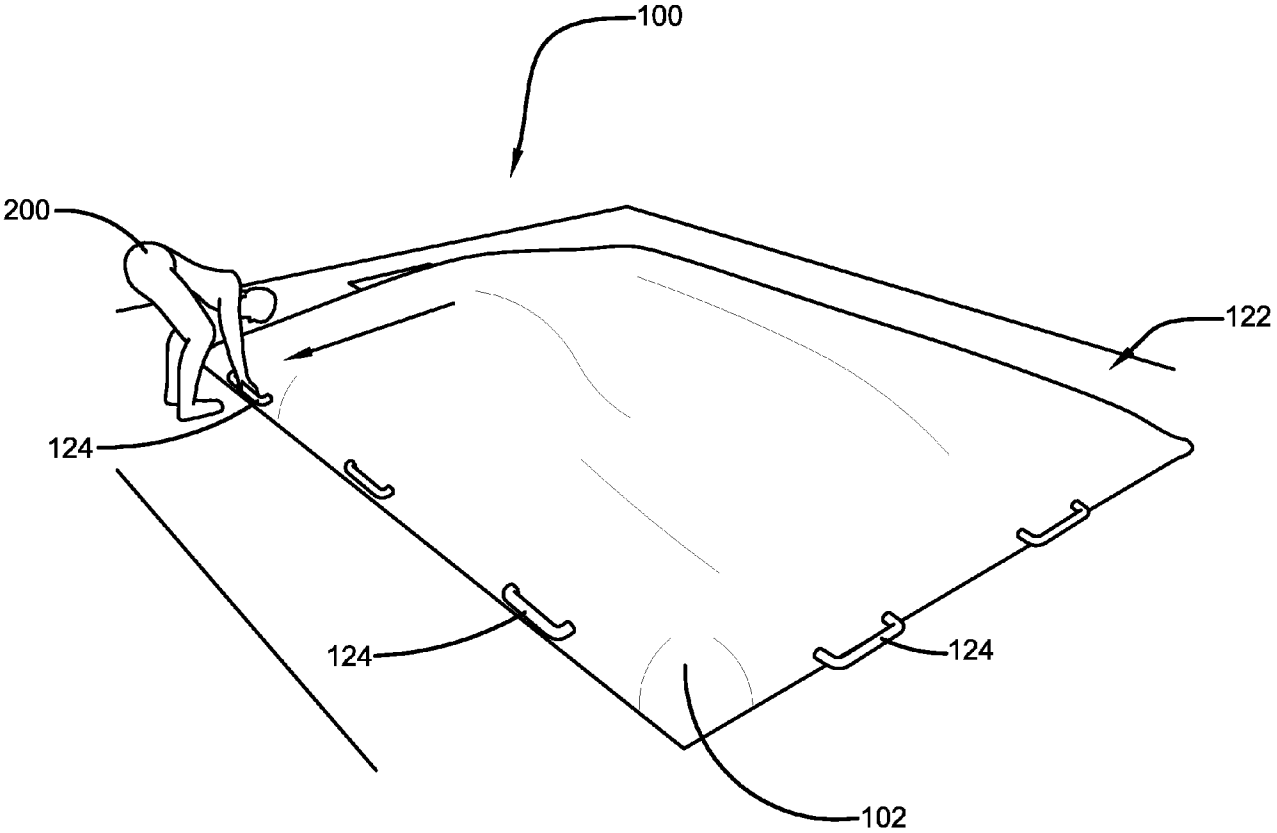
FIG. 3 illustrates a perspective view of the cover device being positioned on a swimming pool in accordance with the disclosed architecture.

The cover device 100 further comprises a plurality of handles 124 which are secured around a perimeter of the flexible member 102. Any number of handles 124 can be used depending on the shape and size of the cover device 100 being utilized, as long as the handles 124 allow a user to easily move the cover device 100 on and off of the swimming pool 122. For example, if a rectangular cover device 100 is used, typically there are three handles 124, spaced apart evenly along the right and left perimeter sides of the cover device 100 and two handles 124, spaced apart evenly along the top and bottom perimeter sides of the cover device 100. Once inflated, a user 200 can grasp at least one handle 124 and pull the cover device 100 onto or off of the swimming pool 122 with relative ease (as shown in FIG. 3).

The handles 124 can be any typical handle as is known in the art that allows a user 200 to grasp a portion of the cover device 100, such as a tubular member secured at each end to the cover device 100 forming an opening for a user 200 to put their hand. The handles 124 are secured to the cover device 100 via any suitable securing means as is known in the art, such as gluing, etc.

The cover device 100 further comprises a skirt 126 that is secured around a perimeter of the flexible member 102, below the plurality of handles 124. The skirt 126 is detachable and can be secured to the flexible member 102 via straps 128 which are tied to the plurality of handles 124, or via any other suitable securing means as is known in the art without affecting the overall concept of the invention. Or, the skirt 126 could be formed as an integral part of the flexible member 102, and would be permanently attached to the flexible member 102. The skirt 126 can be manufactured of the same material as the flexible member 102, such as rip-stop nylon, canvas, polyvinyl chloride (PVC), Kevlar®, or any other similar lightweight, weatherproof, flexible material, etc., though any other suitable material may be used to manufacture the skirt 126 as is known in the art without affecting the overall concept of the invention. The skirt 126 can also comprise a variety of sizes, colors and designs to suit user and manufacturing preference.

Figure 4:
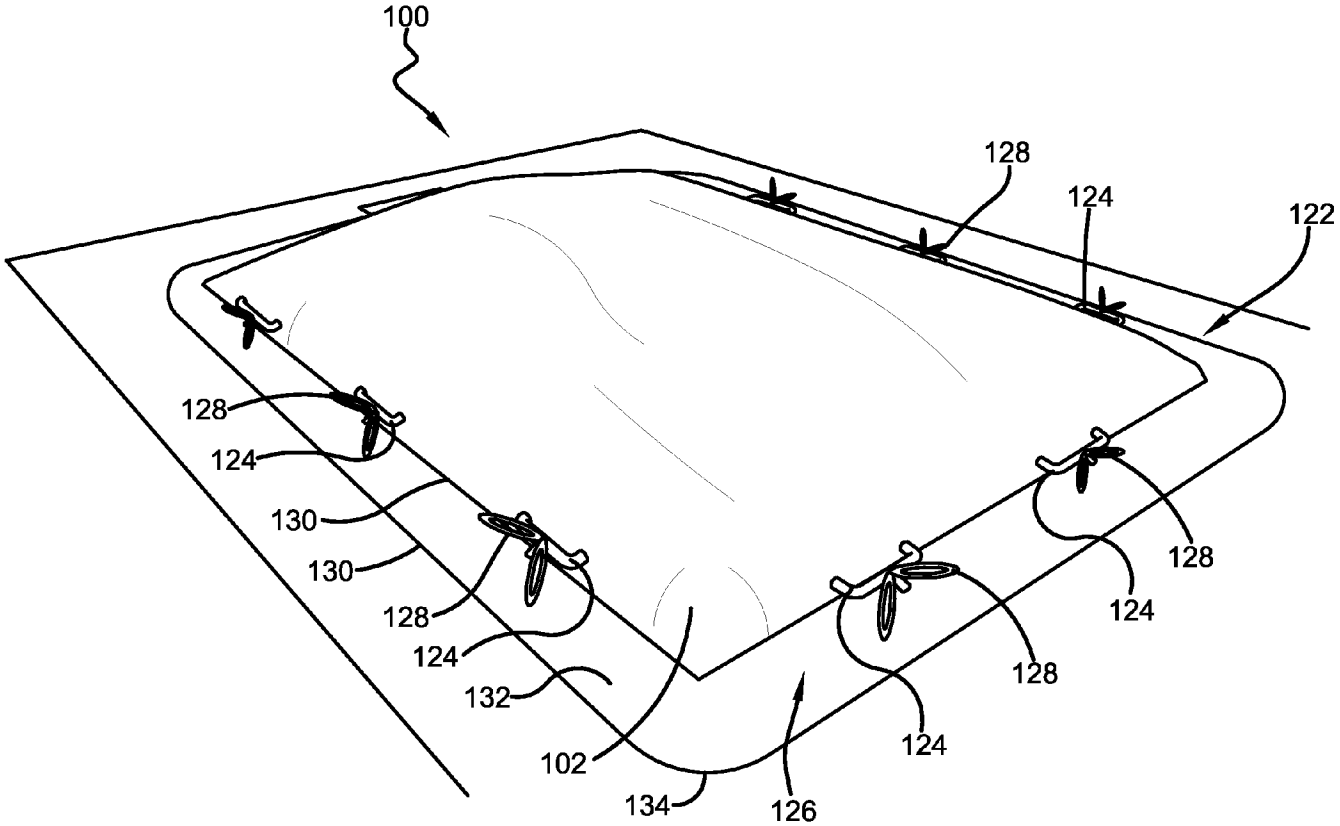
FIG. 4 illustrates a perspective view of the cover device secured to the weighted skirt in accordance with the disclosed architecture.

Generally, the skirt 126 is approximately between 0.5 and 1.5 inches wide as measured from opposing sides 130, and approximately between 0.5 and 1.0 inch high as measured from a front surface 132 to a back surface 134, at its highest point. The skirt 126 would typically be weighted by a user 200, such that the skirt 126 retains the flexible member 102 on the surface of the swimming pool 122. The skirt 126 can be weighted by filling the skirt 126 with sand, or any other suitable weighted material as is known in the art. Once weighted, the skirt 126 can be secured to the flexible member 102 via tying the straps 128 around the handles 124 and around a securing point on the skirt 126 (as shown in FIG. 4). Once secure, the skirt 126 and flexible member 102 act to seal the swimming pool 122, preventing any debris, including leaves, branches, or even small animals from entering the pool water. The weighted skirt 126 seals the sides of the flexible member 102 and helps to retain the flexible member 102 on the surface of the swimming pool 122 and thus acts as a natural pool heater, trapping heat underneath the cover device 100. If the skirt 126 is not weighted, then the cover device 100 including the skirt 126 would have to be tied down to the deck of the pool 122 to prevent the cover device 100 from being blown away.

Furthermore, the cover device 100 can comprise additional components such as solar panels or solar elements (not shown). The solar panels or elements can be removable, such as a pocket insert in the flexible member 102 or the solar panels/elements can be permanently attached to the flexible member 102.

Figure 5A:
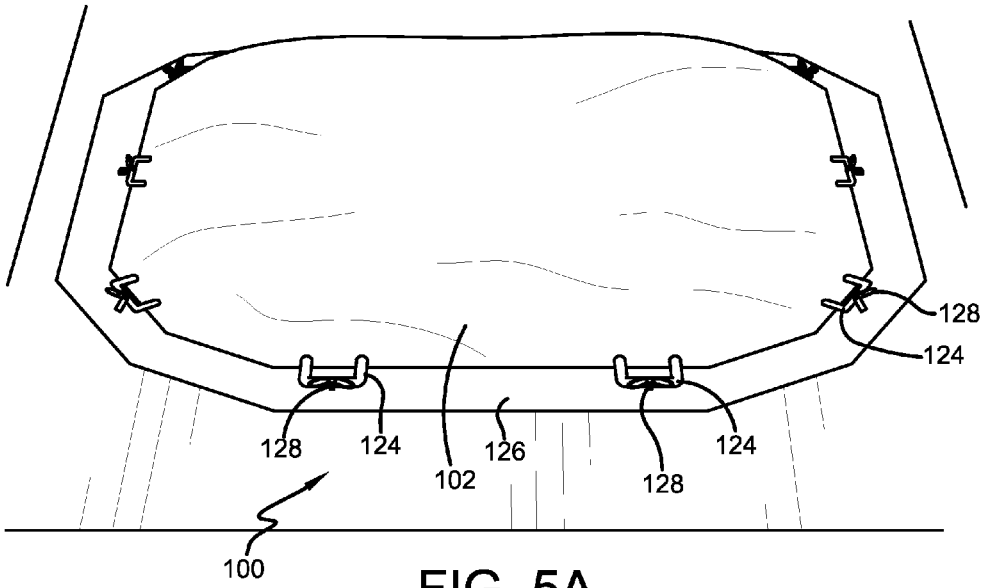
FIGS. 5A and 5B illustrate a perspective view of the cover device in use on different shaped swimming pools in accordance with the disclosed architecture.
Figure 5B:
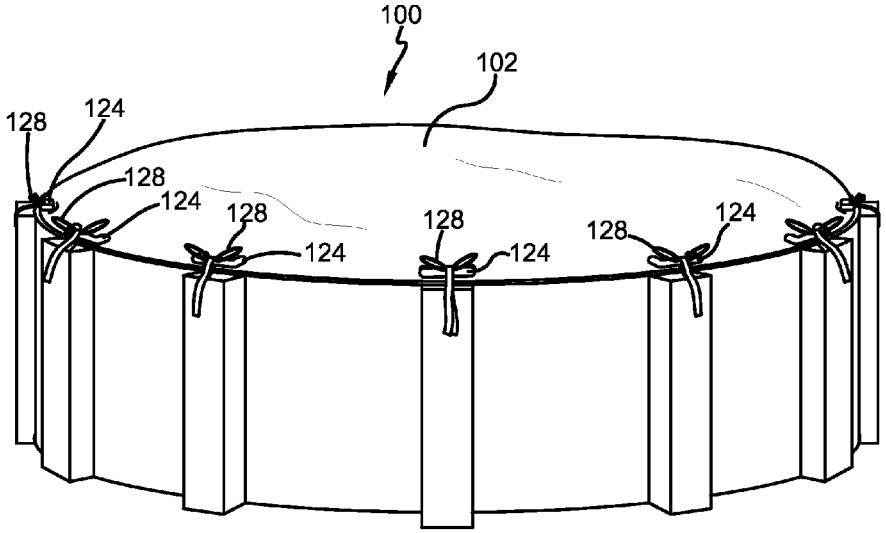

FIGS. 5A and 5B illustrate the cover device 100 in use on different shaped swimming pools. In operation, a user (not shown) would choose the shape, size and/or specific color of the cover device 100 that meets their needs and/or wants, and depending on the size and shape of the swimming pool 122 they want to protect. The user would then remove the cover device 100 from storage and would unfold the flexible member 102 on the ground beside the swimming pool 122.

Once unfolded, the user would then attach an air pump 120 to the pump valve 118 positioned on the exterior surface of the flexible member 102. The user would then pump air into the interior cavity of the flexible member 102, inflating the flexible member 102. Once the flexible member 102 is substantially inflated, (i.e., the interior cavity is substantially filled with air), the exterior surface 104 forms a generally convex shape which allows the flexible member 102 to float on and cover substantially an entire surface of the swimming pool 122.

Once inflated, the user then grasps at least one of the handles 124 and pulls (or drags) the cover device 100 over the surface of the pool 122, till the cover device 100 covers substantially the entire surface of the pool 122. Once in position, the user then unfolds the skirt 126 on the ground beside the pool 122. Once unfolded, the user pulls the skirt 126 into position, around the perimeter of the flexible member 102. Then, the user can weight the skirt 126 by filling the skirt 126 with sand. The user then inflates the skirt 126 with the air pump 120. Once weighted and inflated, the user secures the skirt 126 to the flexible member 102 by tying the straps 128 around the handles 124 and around a securing point on the skirt 126.

Once secure, the skirt 126 and flexible member 102 act to seal the swimming pool 122, preventing any debris, including leaves, branches, or even small animals from entering the pool water. The weighted skirt 126 seals the sides of the flexible member 102 and helps to retain the flexible member 102 on the surface of the swimming pool 122 and thus acts as a natural pool heater, trapping heat underneath the cover device 100. When not in use, the user can deflate the flexible member 102 and skirt 102 (remove the sand), and fold the cover device 100 up for easy storage.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A cover device for a swimming pool comprising:

an inflatable, flexible member comprising an exterior surface and an interior cavity; and a plurality of handles secured around a perimeter of the flexible member; and a skirt secured around the perimeter of the flexible member, below the plurality of handles, wherein the skirt is secured to the flexible member via straps which are tied to the plurality of handles and is formed as an integral part of the flexible member; and wherein when the interior cavity of the flexible member is inflated, the interior cavity fills with air causing the exterior surface to form a convex shape which allows the flexible member to float on and cover substantially an entire surface of the swimming pool.

2. The cover device of claim 1, wherein the skirt is weighted, such that the skirt retains the flexible member on the surface of the swimming pool.

3. The cover device of claim 2, wherein the flexible member comprises a periphery having a general shape of the swimming pool.

4. The cover device of claim 3, wherein when deflated, the flexible member can be folded up for storage.

5. The cover device of claim 4, wherein the flexible member is manufactured of nylon.

6. A cover device for a swimming pool comprising:

an inflatable, flexible member comprising an exterior surface and an interior cavity; and a plurality of handles each constructed as a tubular member configured to form an opening for a user's hand secured around a perimeter of the flexible member; and a skirt secured around the perimeter of the flexible member via straps which are tied to the plurality of handles and, below the plurality of handles; and wherein when the interior cavity of the flexible member is inflated, the interior cavity fills with air causing the exterior surface to form a convex shape which allows the flexible member to float on and cover substantially an entire surface of the swimming pool.

7. The cover device of claim 6, wherein the flexible member comprises a periphery having a general shape of the swimming pool.

8. The cover device of claim 7, wherein the skirt is an integral part of the flexible member.

9. The cover device of claim 6, wherein the skirt is weighted, such that the skirt retains the flexible member on the surface of the swimming pool.

10. The cover device of claim 6, wherein the flexible member is manufactured of nylon.

11. A cover device for a swimming pool comprising:

an inflatable, flexible member comprising an exterior surface and an interior cavity; and a plurality of handles each constructed as a tubular member configured to form an opening for a user's hand secured around a perimeter of the flexible member; and a hollow skirt is secured to the flexible member via straps which are tied to the plurality of handles, wherein the skirt is approximately between 0.5 and 1.5 inches in width and approximately between 0.5 and 1.0 inches in height when filled that is secured around the entire perimeter of the flexible member, below the plurality of handles; and wherein when the interior cavity of the flexible member is inflated, the interior cavity fills with air causing the exterior surface to form a convex shape which allows the flexible member to float on and cover substantially an entire surface of the swimming pool.

12. The cover device of claim 11, wherein the skirt is weighted, such that the skirt retains the flexible member on the surface of the swimming pool.

13. The cover device of claim 11, wherein the flexible member comprises a periphery having a general shape of the swimming pool.

* * * * *